US008516995B2

(12) United States Patent
Sinclair

(10) Patent No.: US 8,516,995 B2
(45) Date of Patent: Aug. 27, 2013

(54) CONTROL METHOD FOR A COMMON RAIL FUEL PUMP AND APPARATUS FOR PERFORMING THE SAME

(75) Inventor: James Sinclair, Perivale (GB)

(73) Assignee: Delphi Technologies Holding S.arl, Luxembourg (LU)

( * ) Notice: Subject to any disclaimer, the term of this patent is extended or adjusted under 35 U.S.C. 154(b) by 323 days.

(21) Appl. No.: 12/843,956

(22) Filed: Jul. 27, 2010

(65) Prior Publication Data

US 2011/0041809 A1 Feb. 24, 2011

(30) Foreign Application Priority Data

Aug. 18, 2009 (GB) ..... 09168037.1

(51) Int. Cl.
*F02M 59/36* (2006.01)

(52) U.S. Cl.
USPC ..... 123/458; 123/501; 417/298

(58) Field of Classification Search
USPC ..... 123/449, 457, 458, 463, 502, 508, 123/696; 417/297, 298
See application file for complete search history.

(56) References Cited

U.S. PATENT DOCUMENTS

| | | | | |
|---|---|---|---|---|
| 5,201,294 | A * | 4/1993 | Osuka | 123/458 |
| 6,450,147 | B2 | 9/2002 | Demura et al. | |
| 7,171,944 | B1 * | 2/2007 | Oono et al. | 123/357 |
| 7,278,405 | B2 | 10/2007 | Takahashi | |
| 7,490,592 | B2 | 2/2009 | Kaneko | |
| 2005/0103312 | A1 * | 5/2005 | Uchiyama | 123/457 |
| 2006/0027213 | A1 * | 2/2006 | Nomura et al. | 123/458 |
| 2007/0056561 | A1 * | 3/2007 | Dolker | 123/458 |
| 2007/0079809 | A1 * | 4/2007 | Oono | 123/456 |
| 2007/0125343 | A1 * | 6/2007 | Hayakawa | 123/447 |
| 2008/0009987 | A1 * | 1/2008 | Williams et al. | 701/31 |
| 2008/0210200 | A1 * | 9/2008 | Cwielong et al. | 123/459 |
| 2008/0294327 | A1 * | 11/2008 | Oono | 701/104 |
| 2009/0276141 | A1 * | 11/2009 | Surnilla et al. | 701/103 |

FOREIGN PATENT DOCUMENTS

| | | |
|---|---|---|
| CN | 1945005 A | 4/2007 |
| DE | 10162989 | 10/2003 |
| EP | 1 030 047 | 8/2000 |
| EP | 1136686 | 9/2001 |

(Continued)

OTHER PUBLICATIONS

Korean Office Action Mar. 9, 2012.

(Continued)

*Primary Examiner* — Stephen K Cronin
*Assistant Examiner* — John Zaleskas
(74) *Attorney, Agent, or Firm* — Mark H. Svoboda

(57) ABSTRACT

A method and apparatus for controlling a fuel pump assembly comprising a plurality of pump elements, each pump element comprising a cam-driven plunger to perform at least one pumping event per engine revolution and a control valve. Each pumping event corresponds to an associated cam lobe of the associated cam. The method comprises, for each pumping event of each pump element, controlling the control valve of said pump element in response to an output control signal derived from at least one previous pumping event. Fuel pressure is measured within a rail volume and compared with a demanded rail pressure value to derive a rail pressure error. A proportional term and an integral term for the rail pressure error are derived and combined to derive the output control signal. Monitoring of the integral term for each pumping event provides a means for identifying and diagnosing a fault condition.

9 Claims, 4 Drawing Sheets

(56) References Cited

FOREIGN PATENT DOCUMENTS

| | | |
|---|---|---|
| EP | 1927744 | 6/2008 |
| JP | 9-79100 | 3/1997 |
| JP | 2000-234572 | 8/2000 |
| JP | 2005-147005 | 6/2005 |
| JP | 2007-32321 | 2/2007 |
| JP | 2007-154758 | 6/2007 |
| JP | 2008-31989 | 2/2008 |
| KR | 10-2008-0011384 | 2/2008 |
| WO | 2006117287 | 11/2006 |

OTHER PUBLICATIONS

Japan Office Action dated Feb. 1, 2012.
European Search Report dated Dec. 8, 2009.
Letter regarding comments and China Office Action dated Dec. 20, 2012.

* cited by examiner

CONTROL METHOD FOR A COMMON RAIL FUEL PUMP AND APPARATUS FOR PERFORMING THE SAME

TECHNICAL FIELD

The present invention relates to a control method for a common rail fuel pump for use in a fuel injection system of an internal combustion engine. The invention also relates to an apparatus for implementing such a method in a common rail fuel pump.

BACKGROUND TO THE INVENTION

In common rail fuel systems for compression ignition internal combustion engines, fuel is pressurized by means of a high-pressure fuel pump, which is supplied with fuel from a fuel tank by a low-pressure transfer pump. Typically, the high-pressure fuel pump comprises a main pump housing supporting multiple pump elements. Each pump element includes a plunger, which is driven in a reciprocating motion by an engine-driven camshaft to generate high fuel pressure. Fuel at high pressure is then stored in a common fuel rail for delivery to fuel injectors.

Typically, a single inlet metering valve is used to meter the fuel entering all of the pump elements. Fuel in the pump elements becomes pressurized during a pumping stroke of the associated plunger. The provision of the inlet metering valve means that, throughout the operational range of the engine, the pumping duty of the high-pressure fuel pump is distributed equally between the pump elements, regardless of whether or not the pump elements are being operated at less than their maximum pumping capacity. Accordingly, the frequency with which each pump element is required to perform a pumping stroke is a maximum.

The Applicant's co-pending EP patent application 09157959.9 describes an alternative fuel pump in which, rather than having a single inlet metering valve across all pump elements, each pump element is provided with its own dedicated metering valve. The plunger of each pump element is driven by an associated engine-driven cam having one or more cam lobes. The control valve of each pump element is operable during a pumping window between bottom-dead-centre and top-dead-centre, corresponding to the rising flank of the relevant cam lobe, to control the quantity of fuel delivered to the rail. The duration of each pumping event within the pumping window determines the quantity of fuel delivered by the pump element into the common rail. In order to achieve the required duration of pumping, the valve must be actuated at the correct position in engine revolution relative to the cam during the pumping window. To achieve full pump capacity for a pump element, the metering valve of that element is actuated over the full pumping window, whereas for zero demand the valve is not actuated over any of the pumping window.

The invention in EP 09157959.9 provides the advantage that the pumping duty of at least one of the pump elements (or at least one of the cam lobes associated with a pump element) can be removed easily by not operating the metering valve associated with that specific pump element, meaning it is not exposed to a pressurising phase of the pumping stroke. The frequency with which that pump element is subject to a pumping stroke is therefore reduced, together with the possibility of fatigue failure. Furthermore, it has been recognised that due to clearances between components of the pump elements, the pump elements are subject to high-pressure fuel leakages during the pumping stroke. The high-pressure fuel leakages represent a reduction in pump efficiency as the pressurized fuel is not entirely displaced to the common fuel rail. The invention in EP patent application 09157959.9 overcomes this problem.

Another desirable feature of such common rail fuel pumps is that rail pressure is controlled and maintained accurately so as to maintain injection pressure. It is an object of the present invention to provide a method of controlling rail pressure in a common rail fuel pump of the aforementioned type in which this object is achieved.

SUMMARY OF THE INVENTION

In accordance with a first aspect of the present invention, there is provided a method for controlling a fuel pump comprising a plurality of pump elements for delivering fuel at high pressure to a rail volume, each of the pump elements comprising a plunger which is driven by an associated cam to perform at least one pumping event per engine revolution and a control valve for controlling fuel flow into and/or out of the pump chamber, each pumping event corresponding to an associated cam lobe of the associated cam, the method comprising, for each pumping event of each pump element, controlling the control valve of said pump element in response to an output control signal derived from at least one previous pumping event. The output control signal is derived by measuring fuel pressure within the rail volume to derive a measured rail pressure value and comparing the measured rail pressure value with a demanded rail pressure value to derive a rail pressure error. A proportional and integral calculation is performed on the rail pressure error to derive a proportional term for the rail pressure error and an integral term for the rail pressure error; and the proportional term and the integral term are combined (e.g. summed) to derive the output control signal.

The method provides the advantage that rail pressure within the rail volume can be maintained at substantially the required level, irrespective of the performance of any one of the pump elements.

In a preferred embodiment, the integral term of the rail pressure error is the cumulative integral term derived from a plurality of previous (e.g. most recent) pumping events for the associated cam lobe of the associated pump element.

In one embodiment, the integral term may be reset periodically. For example, in a preferred embodiment the integral term may be reset each time a rail pressure of zero is demanded (e.g. including key off). In this case the integral term of the rail pressure error is the cumulative integral term derived from the pumping events that have occurred since a zero rail pressure demand for the associated cam lobe of the associated pump element.

In a further preferred embodiment, the proportional term is calculated as the rail pressure error multiplied by a proportional gain factor, the rail pressure error being that error measured for the immediately previous pumping event, regardless of which pump element said immediately previous pumping event is associated with.

The proportional gain factor may be a constant value, or alternatively may be a mapped value dependent on one or more engine conditions e.g. speed, load, and rail pressure.

In a further preferred embodiment, the step of measuring the fuel pressure within the rail volume comprises measuring the rail pressure several times and calculating an average rail pressure value, and wherein the step of comparing includes comparing the average rail pressure value with the demanded rail pressure value.

In a preferred embodiment, the method is applied to a pump assembly having a plurality of pump elements, each of which is driven by an associated cam having at least two cam lobes (i.e. a multi-lobe cam) to perform at least one pumping event per engine revolution.

It is a further advantage of the invention that, because the integral term for the rail pressure error is calculated for each cam lobe of each pump element independently, it can be monitored for diagnostic purposes i.e. to identify and characterise the presence of a fault condition.

By way of example, in a fuel pump having pump elements with multi-lobe cams, the integral term of a first one of the cam lobes of a pump element may be compared with the integral term for the or each of the other cam lobes of the same pump element; and, on the basis of that comparison, the nature of the fault condition can be identified. If, for example, the integral terms of the rail pressure error of the cam lobes associated with the same pump element are observed to change to a different extent to one another, then this may be indicative of a non-pump element related fault e.g. a fault in one of the injectors.

Alternatively, if the integral terms of the cam lobes of the same pump element change by substantially the same amount then this may be indicative that there is a pump element related fault e.g. a leak problem in that pump element.

Preferably, only the integral terms corresponding to substantially the same engine condition are compared.

In another method, the integral term of a given cam lobe of a given pump element may be compared with pre-stored data to determine whether there is a fault, and the nature of that fault.

In a second aspect of the invention, there is provided an apparatus for performing the method of the first aspect of the invention. Such apparatus may include means for implementing any one or more of the preferred and/or optional method steps of the first aspect of the invention.

It will be appreciated that the invention is equally applicable to a fuel pump in which the cam for each pump element is a single-lobe cam, as well as for pumps in which the cams have multiple lobes. The invention is applicable to a fuel pump having any multiple number of pump elements (e.g. two, four, six or more) feeding one or more common rail.

BRIEF DESCRIPTION OF THE FIGURES

The invention will now be described, by way of example only, with reference to the accompanying drawings, in which:

FIG. 2(*a*) shows the status of an injection control valve of one of the injectors;

FIG. 2(*b*) shows the rail pressure;

FIG. 2(*c*) shows the drive pulse for the metering valve associated with the pump element;

FIG. 2(*d*) shows the duration of the pumping event; and

FIG. 2(*e*) shows the lift of the cam;

DETAILED DESCRIPTION OF PREFERRED EMBODIMENTS

The control method of the invention is applicable to a high-pressure fuel pump assembly for a compression ignition internal combustion engine having multiple pump elements which operate in a phased cyclical manner.

Figure 1:
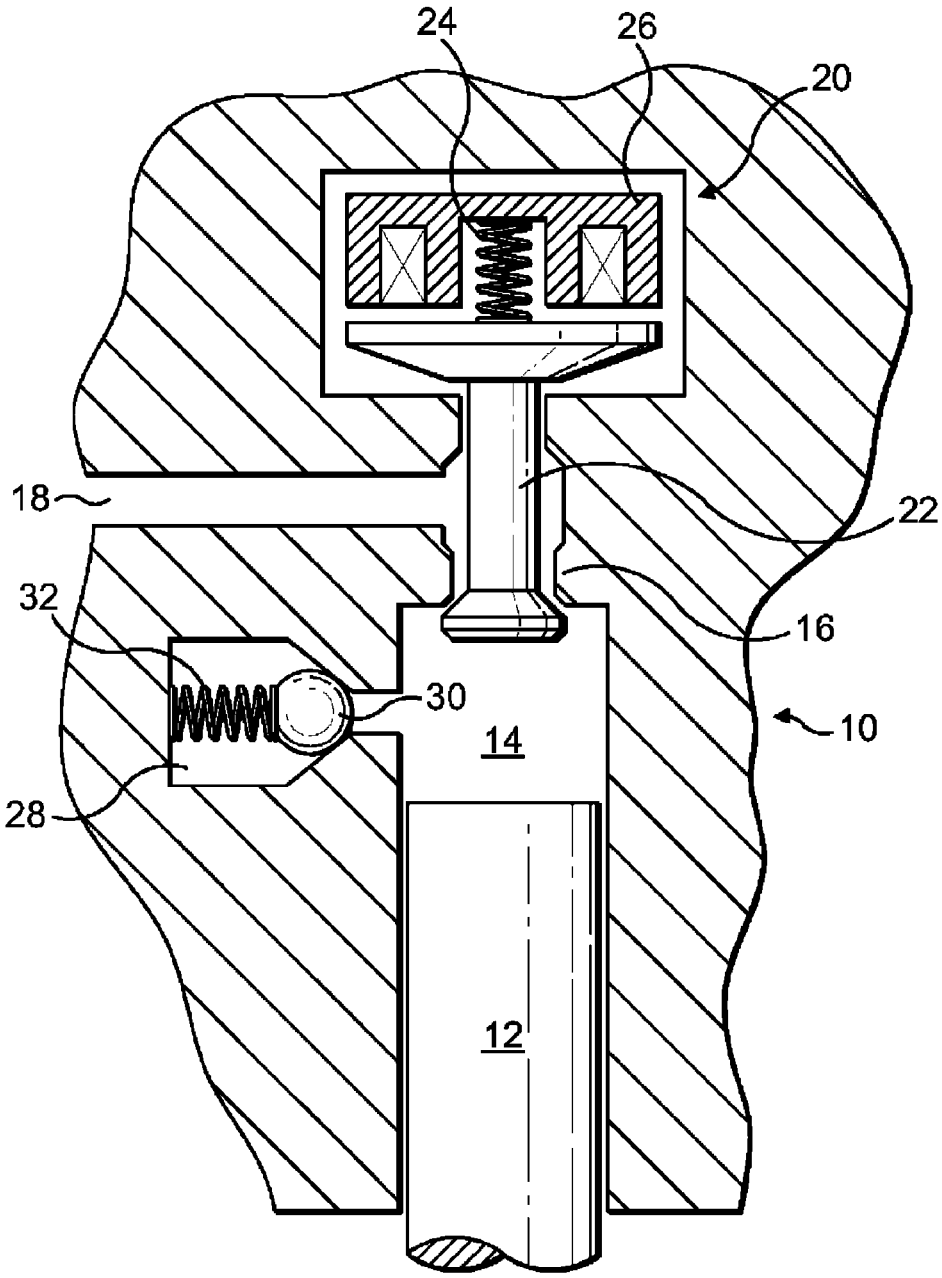
FIG. 1 is a sectional view of one of the pump elements of a high-pressure fuel pump of a common rail fuel system for an engine, comprising a plurality of pump elements each having its own dedicated metering valve.

Referring to FIG. 1, each pump element 10 is identical and includes a plunger which is used to pressurise fuel within the pump element for delivery to a fuel rail volume (not shown) common to each of the other pump elements of the pump assembly. For the purpose of simplicity, only one of the pump elements of the assembly will be described in detail, but it will be appreciated that each of the other pump elements are constructed and operated in a similar manner.

It should be appreciated at this point that the 'pump element' is used in the general sense and covers a pump arrangement having a series of pumping elements housed within a common housing element, for example in a pump sometimes known as an in-line common rail pump. Alternatively, each pump element may be housed within respective (individual) housing elements, thereby forming separate pumping modules such as referred to in the art as a 'unit pump', or a 'unit injector' when combined with an injector module, several of which unit pumps module working together to supply a common rail devices.

The plunger 12 is driven by means of a cam (not shown) mounted on an engine-driven cam shaft, each cam typically having at least one cam lobe with a rising flank and a falling flank. The pump element 10 includes a pump chamber 14 and an inlet passage 16 to the pump chamber 14. The inlet passage 16 is in communication with a low-pressure transfer pump (not shown) via a supply passage 18. The inlet passage 16 can be isolated from the pump chamber 14 by means of a solenoid latching valve (referred to as the control valve), referred to generally as 20.

The control valve 20 includes a valve member 22 which is biased open by means of a control valve spring 24. An actuator 26 for the control valve is controlled by means of an Engine Control Unit (ECU) (not shown in FIG. 1) and, when actuated, serves to urge the valve member 22 into a closed position, against the spring force, in which communication between the pump chamber 14 and the inlet passage 16 is broken. The provision of the control valve 20 enables fuel that is displaced by the pump element 10 to be metered independently of the motion of the plunger 12 i.e. the control valve does not respond automatically to the motion of the plunger 12.

The plunger 12 is in a bottom-dead-centre position (referred to as bottom-dead-centre) when at a lowermost position in the illustration shown (i.e. when the volume/capacity of the pump chamber 14 is a maximum) and in a top-dead-centre position (referred to as top-dead-centre) when at an uppermost position (i.e. when the volume/capacity of the pump chamber 14 is a minimum). A pump cycle is said to have occurred when the plunger has moved from top-dead-centre to the bottom-dead-centre, and back to top-dead-centre.

An outlet passage 28 from the pump chamber 14 can be isolated from the pump chamber 14 by means of a hydraulically operated non-return outlet valve 30 (referred to as the outlet valve). Such a valve is sometimes also referred to in the art as a 'check valve'. The outlet passage 28 is in direct communication with the common rail so that pressure in both is substantially equal. The common rail receives pressurized fuel from the outlet passage 28 from each pump element of the pump assembly when the associated outlet valve is open. The outlet valve 30 is biased into a closed position by high pressure fuel in the common rail, acting in combination with an outlet valve spring 32. In practice, the biasing forces provided by the inlet valve spring 24 and the outlet valve spring 32 are relatively low and provide a much less significant force than the pressure of fuel to which the valves are exposed.

In use, when the control valve 20 is open and the plunger 12 is moving between top-dead-centre and bottom-dead-centre (i.e. corresponding to the falling flank of the cam lobe), fuel is delivered from the inlet passage 18 to the pump chamber 14. This part of the pump cycle is referred to as a filling stroke as it is that part of the cycle for which the pump chamber 14 fills with fuel at low pressure. The outlet valve 30 is biased into the closed position throughout the filling stroke due to the force of high pressure fuel in the outlet passage (and the common rail) and the force from the outlet valve spring 32. Fuel delivery to the pump chamber 14 terminates at the end of the filling stroke, when the plunger 12 reaches bottom-dead-centre.

FIG. 1 shows the pump element 10 during the filling stroke of the plunger: when the control valve 20 is deactivated, and fuel is supplied, by means of the transfer pump, to the pump chamber 14 through the inlet passage 18.

The subsequent pumping stroke of the plunger 12 is best illustrated with reference to FIG. 2, which shows the relative timing of events in a pump cycle during one combustion cycle of the engine, that is to say 720 degrees of engine rotation. Note that the cam shaft of the pump rotates at half the speed of engine rotation so performs one complete 360 degree rotation during the 720 degree rotation of the engine.

Shortly after the reference point at 0 degrees of engine rotation, the plunger 12 is at bottom-dead-centre. The period between bottom-dead-centre and top-dead-centre is referred to as the pumping window, as illustrated in FIG. 2(*e*), and represents that part of the pump cycle during which fuel pressurisation can take place due to motion of the plunger 12, if the associated control valve 20 is closed. A pre-determined time after bottom-dead-centre, a control signal is applied to the control valve 20 causing it to close so that continued movement of the plunger 12 towards top-dead-centre causes fuel pressurisation to take place within the pump chamber 14.

Figure 2:
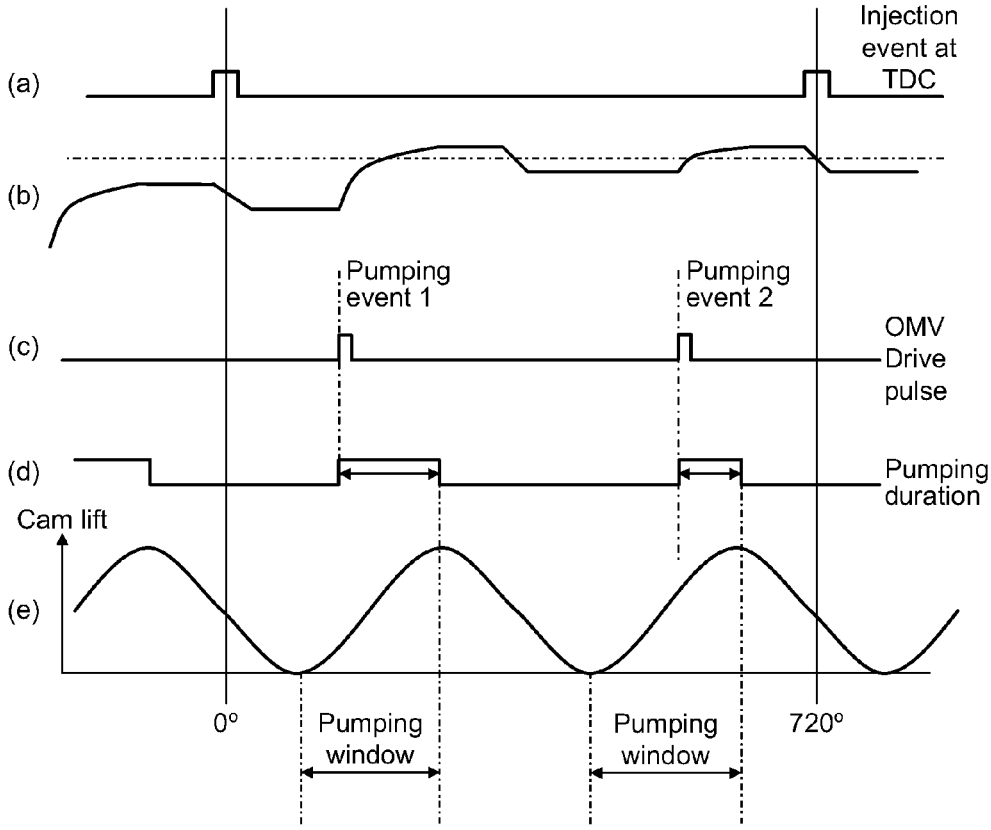
FIGS. 2(*a*) to (*e*) show the relative timing of events for a pump cycle of a pump element of the fuel pump in FIG. 1 with a single cam having two cam lobes pumping fuel into a common rail connected to two cylinders, and hence two injectors, of the engine over one rotation of the cam shaft rotating at half engine crankshaft speed, and in particular.

For the twin-lobe cam arrangement, there are two pumping events over one rotation of the cam shaft, so the commencement of two pumping events is identified in FIG. 2(*c*) as PUMPING EVENT 1 and PUMPING EVENT 2.

Once it has been activated, the control valve 20 remains closed throughout the remainder of the pumping stroke until, when the fuel pressure in the pump chamber 14 exceeds an amount sufficient to overcome the fuel pressure in the outlet passage 28, the outlet valve 30 is caused to open. Pressurized fuel within the pump chamber 14 is therefore able to flow through the outlet passage 28 into the common rail. Once fuel pressure in the pump chamber 14 starts to decrease, the control valve 20 is caused to open again under the action of the spring 24.

By controlling the position at which the control valve 20 of each pump element is closed for a given pumping event, the duration for which the control valve 20 is held closed is controlled and, hence, the rail pressure (as illustrated in FIG. 2(*b*)) can be maintained at the desired level for the next injection event. For pumping events 1 and 2 in FIG. 2, the control valve is actuated for a different duration so that each event results in a different fuel volume being delivered to the common rail. For example, in order to displace a maximum amount of fuel, which corresponds to the maximum volume/capacity of the pump chamber 14, the control valve 20 is closed at the start of the pumping window and remains closed until top-dead-centre. It will be appreciated that the maximum pump capacity of the pump assembly is therefore achieved when all pump elements of the assembly are operated in the aforementioned manner (i.e. maximum capacity) for all cam lobes. In other modes of operation, the control valve 20 can be used to meter the amount of fuel displaced by the plunger 12 during the pumping stroke to precisely meet the demands of the engine at any given time. This can be achieved by closing the control valve 20 later in the pumping window, as illustrated for pumping event 2 in FIG. 2(*c*).

By way of example, for a six-cylinder engine, the pump assembly may have three pump elements, each having its own respective cam and each cam being identical and having two cam lobes, numbered cam lobe-1 and cam lobe-2, as in FIG. 2. Cam lobe-1 corresponds to pumping event 1 for the first pump element and will be denoted by the terminology "pumping event 1-1". Likewise, cam lobe-2 for the first pump element will be denoted by the terminology "pumping event 1-2". In the following description, the same terminology will be adopted for the second pump element, namely pumping events 2-1, 2-2, and so forth for higher-numbered pump elements. In such an example it will be appreciated that there will be six pumping events for each revolution of the pump's camshaft i.e. two pumping events for each of the three pump elements. Other combinations are also possible to give six pumping events per camshaft revolution, for example, six pump elements each having a single cam lobe, or two pumping elements each having a three-lobe cam. Equally, while there are attractions in having the same number of pumping events per camshaft revolution as there are engine cylinders, this is not an essential requirement.

The present invention provides a control method for the fuel pump in FIG. 1 in which rail pressure is evaluated, and subsequent pumping events are adjusted accordingly in response to the evaluation, so as to maintain injection pressure at the desired value.

Figure 3:
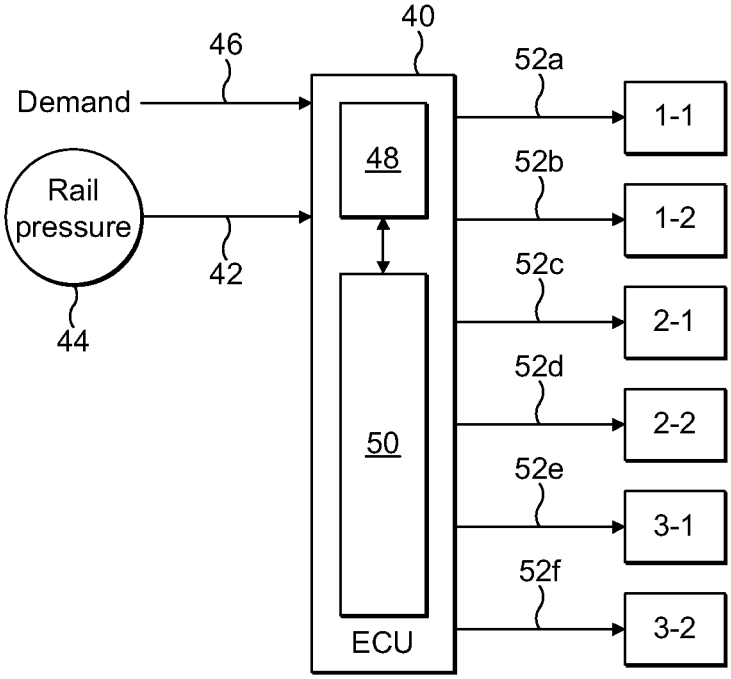
FIG. 3 is a schematic block diagram of the control system for the fuel pump in FIG. 1, including an Engine Control Unit (ECU)

FIG. 3 is a schematic diagram of the control system for the pump assembly in FIG. 1, in a fuel system having three pump elements. The control system includes an Engine Control Unit (ECU) 40 which receives a sampled signal 42 from a measuring arrangement in the form rail pressure sensor 44 and processes this signal independently, for each pumping event of each of the three pump elements 10, using the process illustrated shown in FIG. 4. The sampled signal 42 of rail pressure is compared with a demanded rail pressure value 46 and the difference is calculated within a comparator 48 of the ECU 40. The ECU 40 also incorporates a proportional integral (PI) controller 50 which receives the difference signal from the comparator 48 and performs a proportional integral calculation on the difference signal for each pumping event independently, as described in further detail below.

The ECU 40 generates a plurality of output signals 52*a*-52*f* on the basis of the PI calculation so as to adjust the control valve of the associated pump element for the next pumping event. In other words, an output signal 52*a* is generated for the control valve of pump element-1 for each pumping event 1-1 from the first cam lobe of pump element-1 and, likewise, an output signal 52*b* is generated for the control valve of pump element-1 for each pumping event 1-2 from the second cam lobe of pump element-1. In a similar way, an output signal 52*c* is generated for the control valve of pump element-2 for each pumping event 2-1 from the first cam lobe of pump element-2, and an output signal 52*d* is generated for the control valve of pump element-2 for each pumping event 2-2 from the second cam lobe of pump element-2. Finally, an output signal 52*e* is generated for the control valve of pump element-3 for each pumping event 3-1 from the first cam lobe of pump element-3, and an output signal 52*f* is generated for the control valve of pump element-3 for each pumping event 3-2 from the second cam lobe of pump element-3.

It is an important feature of the invention that control of the pumping events on each cam lobe is carried out independently of the control of the or each of the other cam lobes on the same pumping element, and independently of each of the other pump elements.

Figure 4:
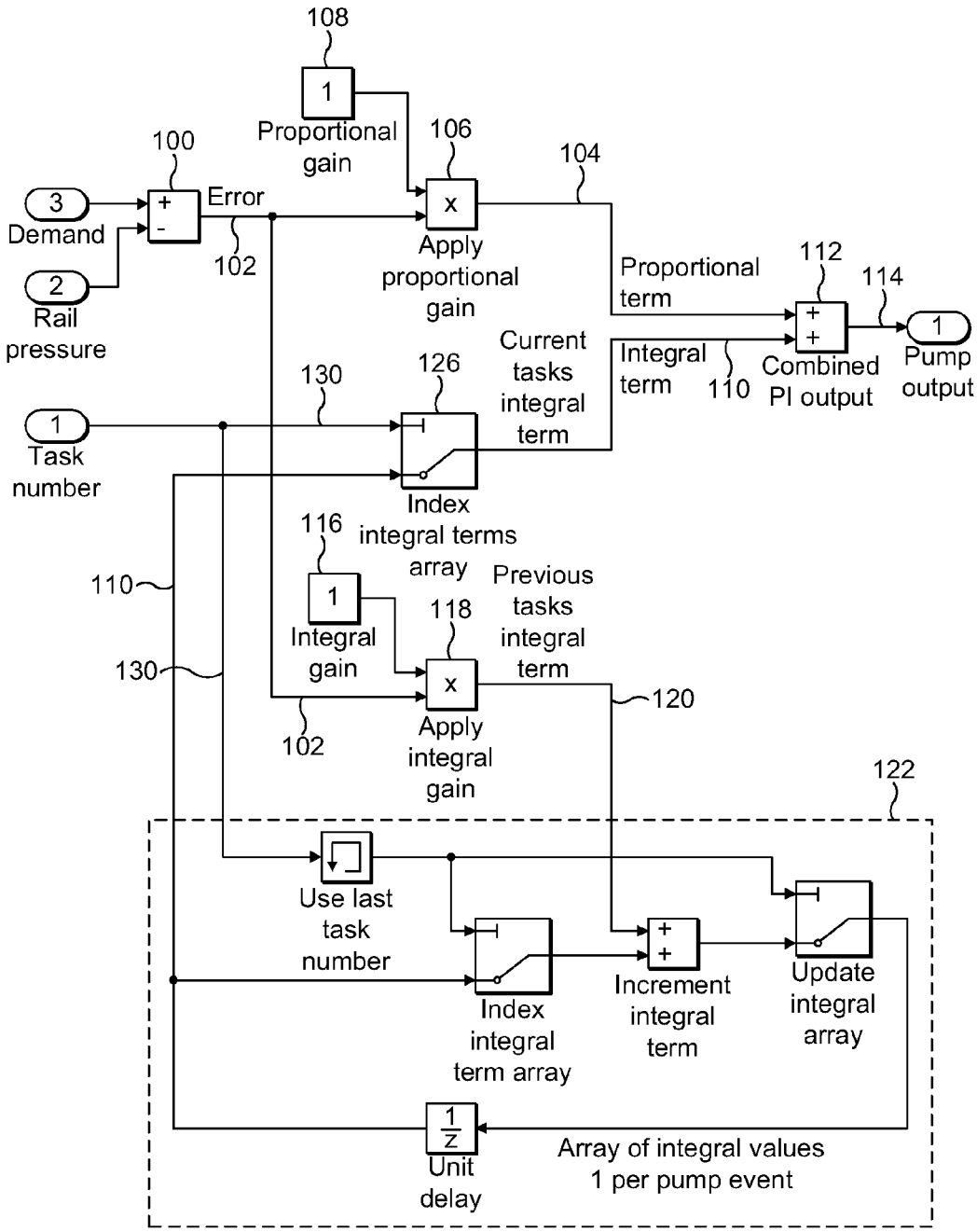
FIG. 4 is a system control diagram to illustrate the process steps implemented in the ECU in FIG. 3.

FIG. 4 illustrates the control method carried out by the ECU in further detail. Using PI control of rail pressure, the rail pressure error signal is evaluated to calculate an integral term and a proportional term which are then used to derive the appropriate control signal for the subsequent pumping event.

By way of background to the invention, conventional PI control is used to control the measurable output of a process that has a desired or ideal value of that output and a control input to that process. A PI control method works by comparing the ideal value with the measured output and calculating an error signal, and then analysing this error signal to derive a proportional term and an integral term which are used to modify the subsequent control input so that the measured output is adjusted appropriately to converge on its ideal value.

The proportional term makes a change to the output of the controller that is proportional to the current error value. The proportional response can be adjusted by multiplying the error by a proportional gain factor. A high proportional gain factor results in a large change in the controller output for a given change in the error at the input to the controller. If the proportional gain factor is too high, the system can become unstable. In contrast, a small gain factor results in a small output response for a large error at the input, and a less responsive (or sensitive) controller. If the proportional gain factor is too low, the control action may be too small when responding to system disturbances.

In the absence of disturbances, pure proportional control will not settle at its target value, but will retain a steady state error that is a function of the proportional gain and the process gain. The contribution from the integral term is proportional to both the magnitude of the error and the duration of the error. Summing the instantaneous error over time (integrating the error) gives the accumulated offset which is then multiplied by the integral gain and added to the controller output. The magnitude of the contribution of the integral term to the overall controller output is determined by the integral gain.

When added to the proportional term, the integral term accelerates the movement of the process towards its ideal value and eliminates the residual steady-state error that occurs with a proportional-only controller.

Referring in more detail to FIG. 4, in the specific example of the present invention each pumping event is assigned a task number at input 1 to the ECU. For example, the pumping events for pump element 1 are denoted 1 and 2 (for a twin-lobe cam). For each pumping event, the rail pressure is sampled and received by the ECU at input 2 (signal 42 in FIG. 3). At input 3, the ECU receives a demand signal (signal 46 in FIG. 3), that is the demanded value of rail pressure corresponding to the current engine operating conditions (e.g. speed and load). Typically, for each pumping event, the rail pressure is measured several times at high frequency so as to generate a "burst sample" in a conventional manner. By averaging the multiple rail pressure readings to return a single reading it is possible to reduce the effects of noise on the signal and to improve the resolution of the sensor 44 and the subsequent analogue to digital conversion of the signal within the ECU.

For each pumping event for each pump element 10 the demanded rail pressure is compared with the sampled rail pressure at the comparator (step 100) to derive a rail pressure error 102. The proportional term 104 for the rail pressure error 102 is then calculated at step 106 by multiplying the rail pressure error 102 by a proportional gain factor 108. The proportional term 104 for the current pumping event is derived from the proportional gain factor 108 and the rail pressure error signal taken before the immediately preceding pumping event. For this calculation the immediately preceding pumping event need not be a pumping event corresponding to the same cam lobe of the same pump element, but a pumping event for one of the other pump elements. The proportional gain factor 108 may be a constant value, or may alternatively be mapped against engine conditions such as speed and rail pressure.

This proportional term 104 is then summed at step 112 with a corresponding integral term 110 for the rail pressure error signal. The summed output (the combined output signal) 114 is then fed back to the control valve 20 of the associated pump element 10 to control its subsequent pumping event for the same cam lobe on the next pump cycle.

To calculate the integral term 110 of the rail pressure error signal, an integral gain 116 is applied to the rail pressure error signal 102 at step 118 to derive an integral gain output 120. The integral gain output 120 is then integrated in an integrator function, as indicated in dashed lines 122, which also receives a signal 130 indicating the current task number. As for a conventional integrator function, the integral gain output 120 is summed with the existing integral gain output (i.e. the integral gain output term at the previous task number) to produce a summed integral term 110.

In contrast to the proportional term 104 which is derived from the rail pressure reading taken before the previous pumping event (which is not necessarily associated with the same cam lobe of the same pumping element), the integral term 110 is based on the most recent rail pressure readings for the same cam lobe of the same pump element and is the evolving integral term derived for previous pumping events for the same cam lobe of the same pump element. The integral term 110 of the rail pressure error is therefore the cumulative integral term derived from previous pumping events for the associated cam lobe of the associated pump element. Typically, the integral term 110 may be reset periodically each time a rail pressure of zero is demanded. In this case the integral term of the rail pressure error is the cumulative integral term derived from the most recent pumping events that have occurred since a zero rail pressure demand for the associated cam lobe of the associated pump element.

An integral term data store is updated at step 126 by assigning the relevant task number 130 to the integral term 110 which is output from the integrator function 122. The summed output 110 from the integrator function 122 is summed at step 112 with the proportional term 104, as mentioned previously, to derive an output signal 114 for the control valve 20 for the next pumping event for the relevant cam lobe of that pump element. When added to the proportional term, the integral term accelerates the movement of the rail pressure error signal towards zero and eliminates the residual steady-state error that occurs with a proportional only controller. The integral term is responsible for giving a fast response to the rail pressure error.

The combined output signal controls the duration for which the control valve is held closed, and therefore controls the duration of the subsequent pumping event for the associated cam lobe of the associated pump element. If the control valve is a latching valve, as in the example shown in FIG. 1, the duration for which the control valve is held closed is determined by the point at which the control valve is closed as the plunger moves between bottom-dead-centre and top-dead-centre, the control valve remaining latched in its closed position until the plunger reaches top-dead-centre and starts to ride over the falling flank of the cam lobe. The duration for which the control valve is held closed determines the amount of fuel metered to the common rail during the subsequent pumping event, and hence maintains the pressure of fuel in the rail at the desired level.

Using the control method of the invention, the output signal for the control valve of each pump element is controlled independently for each cam lobe. The integral term reacts to the most recent rail pressure error measured after the previous pumping event for the relevant cam lobe event (i.e. one cam revolution previous) to compensate for pressure overshoot or shortfall. It is an important feature of the invention that each cam lobe of each pump element is monitored independently by sampling rail pressure for each cam lobe of each pump element independently and calculating independent proportional and integral terms for each pumping event, the proportional term being derived from the previous pumping event (i.e. for whichever pumping event immediately preceded the current pumping event regardless of the cam lobe to which it relates) and the integral term being derived only from the previous pumping events corresponding to the same cam lobe of the same pump element.

A further benefit of the invention is that the integral term 110 for each cam lobe of each pump element (i.e. the summed integral term derived from the integrator) can be used for diagnostic purposes as it carries unique information about the relevant pump element. For example, if a particular pump element experiences pump leakage or has a performance shift, each pumping event for that pump element will be affected in substantially the same way so that the integral term 110 for each cam lobe of that pump element should change in a similar manner. However, the change would not be expected in the integral term 110 for any of the other pump elements. In contrast, an external leakage in the system that is not attributable to a specific pump element would result in the integral term 110 for each cam lobe of each pump element changing in the same way because, in this case, each pumping event will be affected in a similar manner. In another example, an injector fault may be identified if the integral term 110 for one cam lobe of one pump element is seen to change at a different rate from that associated with the other cam lobe(s) for the same pump element. In a still further example, the integral term may be monitored for a given engine condition (e.g. speed, load, rail pressure) and compared to previous or ideal values to determine system degradation or faults.

The Applicant's co-pending EP patent application 09157959.9 describes a method of selectively disabling certain pumping events for a pump element, or for selectively disabling certain pump elements altogether, so as to create an uneven distribution in pumping capacity across the pump elements. Generally, it is desirable for pump systems to be set-up to have synchronous pumping and injection events, so a potential drawback of this method is that it results in non-synchronous pumping and injection events. However, by implementing the control method of the present invention in a pump assembly operating with selective pump elements/pumping events only, the duration of the selected pumping events will be adapted so as to maintain substantially constant fuel pressure in the common rail, even allowing for non-synchronous pumping/injection.

The invention claimed is:

1. A method for controlling a fuel pump assembly comprising a plurality of pump elements for delivering fuel at high pressure to a rail volume, each of the pump elements comprising a plunger which is driven by an associated cam having at least two cam lobes to perform at least one pumping event per engine revolution and a control valve for controlling fuel flow into and out of a pump chamber, each pumping event corresponding to an associated cam lobe of the associated cam, the method comprising, for each pumping event of each pump element, controlling the control valve of said pump element in response to an output control signal derived from at least one previous pumping event; wherein the output control signal is derived by: measuring fuel pressure within the rail volume to derive a measured rail pressure value; comparing the measured rail pressure value with a demanded rail pressure value to derive a rail pressure error; performing a proportional and integral calculation on the rail pressure error to derive a proportional term for the rail pressure error and an integral term for the rail pressure error; and combining the proportional term and the integral term to derive the output control signal; wherein the integral term of the rail pressure error is the cumulative integral term derived from a plurality of recent pumping events for the associated cam lobe of the associated pump element, wherein the method further comprises monitoring the integral term of each cam lobe of each pump element to identify the presence of a fault condition by comparing the integral term of a first one of the cam lobes of a pump element with the integral term for the or each of the other cam lobes of the same pump element; and, on the basis of the comparison, identifying the nature of the fault condition.

2. The method as claimed in claim 1, wherein the integral term is reset periodically.

3. The method as claimed in claim 1, wherein the proportional term is calculated as the rail pressure error multiplied by a proportional gain factor, the rail pressure error being that error measured for the immediately preceding pumping event, regardless of which pump element said immediately preceding pumping event is associated with.

4. The method as claimed in claim 3, wherein the proportional gain factor is a constant.

5. The method as claimed in claim 3, wherein the proportional gain factor is a mapped value dependent on one or more engine conditions.

6. The method as claimed in claim 1, wherein the output control signal controls the duration for which the control valve of said pump element is closed.

7. The method as claimed in claim 1, further comprising; determining that there is a non-pump element related fault in the event that the integral term of a first one of the cam lobes of a pump element and the integral term for the or each of the other cam lobes of the same pump element change over time to a different extent; and determining that there is a pump element related fault in the event that the integral term of the first one of the cam lobes of a pump element and the integral term for the or each of the other cam lobes of the same pump element change over time by substantially the same extent.

8. The method as claimed in claim 7, wherein only integral terms corresponding to substantially the same engine condition engine load, and rail pressure are compared.

9. The method as claimed in claim 1, further comprising: comparing the integral term of a given cam lobe of a given pump element with pre-stored data to determine whether there is a fault.

* * * * *